United States Patent [19]

Bauer

[11] Patent Number: 4,509,979

[45] Date of Patent: Apr. 9, 1985

[54] METHOD AND APPARATUS FOR THE TREATMENT OF IRON WITH A REACTANT

[75] Inventor: Gerd F. Bauer, Waldo, Wis.

[73] Assignee: Modern Equipment Company, Port Washington, Wis.

[21] Appl. No.: 574,080

[22] Filed: Jan. 26, 1984

[51] Int. Cl.[3] ..... C22C 33/08

[52] U.S. Cl. ..... 75/130 R; 75/53; 75/58; 266/216

[58] Field of Search ..... 75/53, 58, 130 R; 266/216

[56] References Cited

U.S. PATENT DOCUMENTS 3,764,305 10/1973 Andersson ..... 75/130 R
3,833,361 9/1974 Kusaka ..... 75/130 R
3,984,234 10/1976 Claxton ..... 266/216
4,391,636 7/1983 Windish ..... 266/216

*Primary Examiner*—Peter D. Rosenberg

[57] ABSTRACT

A ladle adapted for treatment of molten iron with a reactant comprises a main chamber having sealed top and bottom ends. A teapot spout communicates with the bottom end of the ladle, and a dividing wall extends upwardly inside the main chamber from the bottom end of the ladle and forms a compartment within the main chamber. The compartment is adapted to contain the reactant. An opening in the top end of the main chamber allows placement of the reactant in the ladle compartment, and an airtight cover is mounted on the top end of the main chamber to cover the opening.

11 Claims, 4 Drawing Figures

METHOD AND APPARATUS FOR THE TREATMENT OF IRON WITH A REACTANT

FIELD OF THE INVENTION

The invention relates to the treatment of molten iron with a reactant, and more particularly to the treatment of molten iron with a reactant in a ladle having a teapot spout.

BACKGROUND OF THE INVENTION

While the present invention relates to the formation of any metal by treating molten iron with a reactant, the formation of one type of metal, ductile iron, is of particular concern.

Ductility is generally the capability of a material to bend, warp, or to otherwise plastically deform without failure. Ductile irons generally exhibit a relatively high yield strength which is superior to the yield strength of both grey and malleable irons. Generally, a molten base metal iron may be transformed into ductile iron by inoculating the base metal with a suitable nodularizing agent to form graphite spheroids in the base metal. A high percentage of graphite spheroids generally results in satisfactory ductile iron. Examples of suitable nodularizing agents for producing iron with speroidal graphite are magnesium, calcium, potassium, lithium, sodium, and beryllium. The most commonly used nodularizing agent is magnesium.

One prior method for the production of iron with spheroidal graphite is the "pour-over" process. The pour-over process utilizes a treatment ladle into which a magnesium containing alloy is placed. Then, the molten iron is poured into the treatment ladle to cause vaporization of the magnesium. As the magnesium vaporizes, it is released into the molten iron and forms spheroidal graphite nodules. While in practice it is theoretically possible to use pure magnesium as the nodularizing agent, due to the violence of the reaction between the molten iron and the pure magnesium, most production processes utilize a magnesium containing alloy which moderates the reaction by reducing the rate at which the magnesium vapors are released into the base iron. For example, the percentage of magnesium in the nodularizing agent may vary between 3 percent and 9 percent.

A variation of the pour-over process utilizes a ladle having a teapot spout communicating with the bottom end of the ladle. The teapot spout ladle also includes a dividing wall extending upwardly from the bottom of the ladle and forming a compartment within the ladle for containing the magnesium containing alloy or other nodularizing agent. The dividing wall must reach higher than the highest point of the entrance of the spout into the ladle so that when the molten iron is poured into the teapot spout, the ladle fills from the bottom up, and there is little turbulence when the magnesium containing compartment is flooded.

With this teapot ladle process, it has in the past been assumed that gases, including magnesium fumes, must be allowed to escape from the ladle during the reaction in order to prevent a pressure build-up within the ladle. It has been assumed that such a pressure build-up would cause the molten iron to be blown back out of the teapot spout or cause the ladle to explode. Therefore, although the ladle has been covered on top with a cast iron plate to reduce fuming and to prevent iron from splashing out of the ladle, enough play has been allowed between the top of the ladle and the cast iron plate to equalize the interior pressure build-up with the outside atmosphere. During the reaction, only gases were permitted to escape.

Typically, the cast iron plate has a hole therein positioned above the magnesium containing compartment so that the magnesium containing alloy can be easily placed in the compartment, and a cover is slid over the opening during the reaction.

Disadvantages of this process utilizing a ladle with a teapot spout are that a small amount of magnesium fumes escape during the reaction, and that heat is lost. A further disadvantage is that a significant portion of the magnesium is lost in the form of magnesium oxide or magnesium sulfide. Since magnesium containing alloys are relatively expensive, it would be desirable to increase the magnesium recovery of the process.

Attention is directed to the following U.S. patents which relate to the field of the present invention:

| Patentee | U.S. Pat. No. | Issued |
|---|---|---|
| Windish | 4,391,636 | July 5, 1983 |
| Mannion | 4,312,668 | January 26, 1982 |
| McPherson | 4,210,195 | July 1, 1980 |
| Roberts | 4,134,757 | January 16, 1979 |
| Cole | 4,033,766 | July 5, 1977 |
| Alt | 3,955,974 | May 11, 1976 |
| Lee | 3,870,512 | March 11, 1975 |
| Kusaka | 3,833,361 | September 3, 1974 |
| McCaulay | 3,819,365 | June 25, 1974 |
| Anders | 3,802,680 | April 9, 1974 |
| Mantell | 3,650,516 | March 21, 1972 |
| Parlee | 3,619,173 | November 9, 1971 |

SUMMARY OF THE INVENTION

The invention provides a ladle adapted for treatment of molten iron with a reactant, the ladle comprising a main chamber having sealed top and bottom ends, a teapot spout communicating with the bottom end of the ladle, and a dividing wall extending upwardly inside the main chamber from the bottom end of the ladle and forming a compartment within the main chamber, the compartment being adapted to contain the reactant. The ladle further comprises an opening in the top end of the main chamber to allow placement of the reactant in the ladle compartment, and an airtight cover, i.e. pressure sealed, adapted to be mounted on the top end of the main chamber to cover the opening.

In the preferred embodiment, the airtight cover is movably mounted on the top end of the main chamber by a hinge, the airtight cover being movable between a first position wherein the airtight cover engages the top end of the main chamber and closes the opening in the top end, a second position wherein the airtight cover is at an angle relative to the top end so as to allow access to the opening in the top end of the main chamber.

Preferably, the ladle further comprises means, such as a toggle clamp, mounted on the top end of the main cover for selectively securing the airtight cover in the airtight cover first position. The ladle also preferably comprises a gasket surrounding the opening in the top end of the main chamber to provide a seal between the top end and the airtight cover.

The invention further provides a method for the treatment of molten iron with a reactant, the method being carried out in a ladle having a teapot spout communicating with the bottom of the ladle and a dividing wall extending upwardly from the bottom of the ladle and forming a compartment within the ladle, the compartment being adapted to contain the reactant. The method comprises the steps of placing a quantity of the reactant in the ladle compartment, sealing the top of the ladle with an airtight cover, and pouring molten iron into the ladle through the teapot spout and filling the ladle from the bottom up, thereby effecting a reaction between the reactant and the molten iron. In the preferred application of the method, wherein molten iron is treated with a magnesium containing alloy to form iron with spheroidal graphite, the molten iron poured into the ladle should be at a temperature of between 2,700° and 2,750° F.

Preferably, the airtight cover has an opening therein to allow placement of the reactant in the ladle compartment, and the method further comprises the step of sealing the opening with a second airtight cover before pouring in the molten iron. Also, the preferred reactant is a nodularizing agent and the treatment of molten iron with the nodularizing agent produces iron with spheroidal graphite.

A principal feature of the invention is that the ladle is sealed so that gases from the reaction cannot escape, and so that heat loss during the reaction is reduced. The lack of escaping gases reduces the need for exhaust systems and emission cleaning systems, and the reduction in heat loss saves energy, because less heat input is needed.

Another principal feature of the invention is that greater recovery of the key element in the reactant is provided. When a magnesium containing alloy is used as a nodularizing agent, greater magnesium recovery is achieved. This saves money.

Another principal feature of the invention is that it provides uniform treatment of the molten iron with the reactant.

Another principal feature of the invention is that it provides a non-turbulent mixing of the molten iron with the reactant, thereby reducing the violence of the reaction.

Other features and advantages of the invention will become apparent to those skilled in the art upon review of the following detailed description, claims, and drawings.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 1:
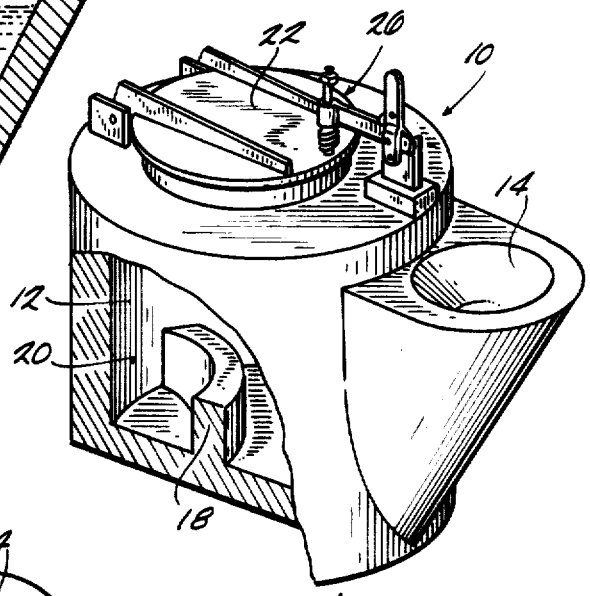
FIG. 1 is a perpsective view of a ladle embodying the invention.
Figure 3:
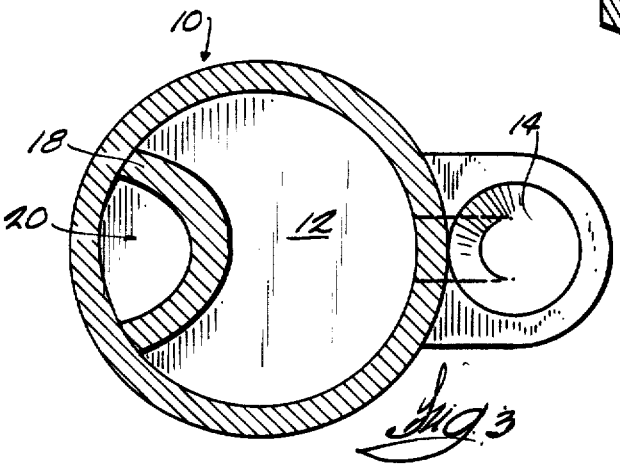
FIG. 3 is a cross sectional view taken along line 3—3 in FIG. 2.
Figure 4:
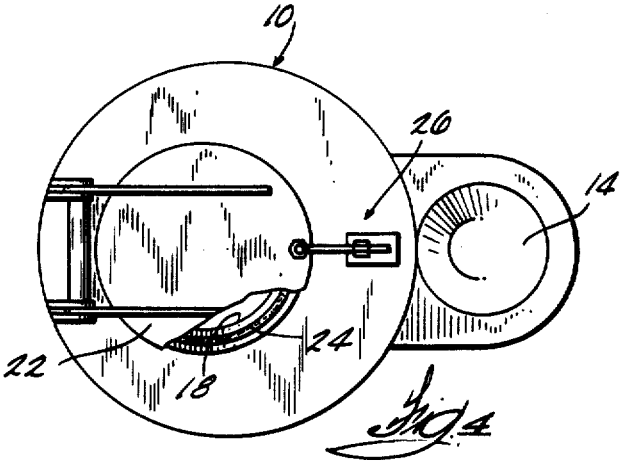
FIG. 4 is a top view of the ladle of FIG. 1.

Illustrated in FIG. 1 is a ladle 10 which both embodies the ladle provided by the invention and illustrates the method of the invention. It should be noted that while the following description is directed specifically to the treatment of molten iron with a nodularizing agent to produce iron with spheroidal graphite, the invention relates to the treatment of molten iron with any reactant.

The ladle 10 includes a main chamber 12 having sealed top and bottom ends and a teapot spout 14 communicating with the bottom end of the ladle 10 through an opening 16. The top of the ladle 10 can be integrally connected to the ladle walls or it can be a separate airtight cover clamped onto the ladle 10. A removable cover is desirable in that it would afford access to the inside of the ladle 10 for cleaning or for other purposes. Preferably, the invention contemplates that the main chamber 12 of the ladle 10 be sealed so that gases from the reaction which is to take place inside the ladle 10 cannot escape.

Figure 2:
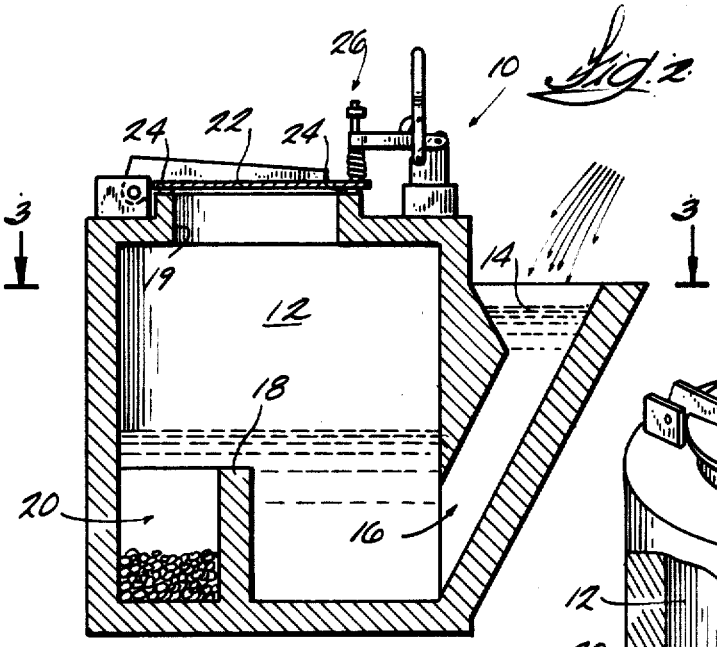
FIG. 2 is a side cross sectional view of the ladle of FIG. 1.

As best shown in FIGS. 1 and 2, the ladle 10 includes a dividing wall 18 extending upwardly inside the main chamber 12 from the bottom end of the ladle 10 to form a compartment 20 within the main chamber 12. This compartment 20 holds the nodularizing agent which reacts with molten iron poured into the ladle 10. The top of the ladle 10, whether it be an integral part of the ladle 10 or a removable cover, includes an opening 19 to allow placement of the nodularizing agent in the ladle compartment 20. The opening 19, as best shown in FIGS. 1 and 2, is located above the ladle compartment 20 so that the nodularizing agent can be poured into the compartment 20 through the opening 19.

The ladle 10 further includes an airtight cover 22 mounted on the top of the ladle 10 for covering the opening 19. While it was previously assumed that sealing the top of such a ladle would result in a dangerous pressure build-up within the ladle, it has been found that if the temperature of the molten iron is maintained below a certain point (to be discussed later), the ladle can be safely sealed.

In the illustrated preferred embodiment, the airtight cover 22 is movably mounted on the top of the ladle 10 by a hinge. A gasket 24 surrounds the opening 19 and is engaged by the airtight cover 22 when it is closed over the opening 19 so that an airtight seal, i.e. pressure sealed, is provided. The airtight cover 22 can be swung upwardly on the hinge so that access to the opening 19 can be gained in order to place the nodularizing agent in the ladle compartment 20.

To assure that the airtight cover 22 remains tightly closed over the opening 19 during the reaction, the ladle 10 further includes means mounted on the top of the ladle 10 for selectively securing the airtight cover 22 in its closed position. While various suitable means could be employed for this purpose, in the illustrated construction, these means comprise a toggle clamp 26 mounted on the top of the ladle 10 adjacent the hinged airtight cover 22 and being movable between a first position wherein the toggle clamp 26 secures the airtight cover 22 in the closed position, and a second position wherein the toggle clamp 26 permits the airtight cover 22 to move to an open position. The toggle clamp 26 provides the advantage of securing the airtight cover 22 during the reaction while allowing the cover 22 to be easily opened and closed to permit access to the ladle compartment 20. Such a toggle clamp 26 is conventional and will not be described in further detail herein.

Referring now to the method of the invention, molten iron is to be treated with a reactant. More specifically, in the preferred embodiment, molten iron is to be treated with a nodularizing agent, commonly a magnesium containing alloy, to produce iron with spheroidal graphite.

The remainder of this description of the preferred embodiment will discuss the invention as it relates to the treatment of molten iron with a magnesium containing alloy to produce iron with spheroidal graphite, but it should be remembered that this is only the preferred embodiment of the invention.

The first step of the method is to place a quantity of the magnesium containing alloy in the ladle compartment 20. With the airtight cover 22 in an open position, the magnesium containing alloy can be placed in the ladle compartment 20 through the opening 19 in the top of the ladle 10.

Thereafter, the top of the ladle 10 is sealed with the airtight cover 22. This is done by closing the airtight cover 22 and then moving the toggle clamp 26 to its second position wherein the airtight cover 22 is secured in the closed position. With the airtight cover 22 closed, gases could only escape, if at all, from the ladle 10 through the teapot spout.

Molten iron is then poured into the ladle 10 through the teapot spout 14. The molten iron enters the ladle 10 and fills the ladle 10 from the bottom up. When the level of the molten iron within the ladle 10 reaches the height of the dividing wall 18 forming the ladle compartment 20, the molten iron floods the compartment 20 and reacts with the magnesium containing alloy. Because the ladle 10 fills from the bottom up, there is little turbulence in the molten metal as it reaches the top of the dividing wall 18 and floods the ladle compartment 20, and this reduces the violence of the reaction between the molten iron and the magnesium. This method of mixing the molten iron with a reactant also results in a uniform treatment of the iron with the reactant.

Because the top of the ladle 10 is sealed, and because molten iron fills the opening 16 of the teapot spout 14, gases resulting from the reaction in the ladle 10, these gases being magnesium fumes when a magnesium containing alloy is used as the nodularizing agent, cannot escape from the ladle 10. This reduces the need for a fume exhausting system and an emission cleaning system. An improved working environment is achieved.

The sealed ladle 10 also provides the advantage of better magnesium recovery from the reaction than is obtained with prior methods and apparatus. This saves a significant amount of money.

As stated above, the temperature of the molten iron must be kept below a certain point in order to avoid a dangerous pressure build-up during the reaction. If the temperature of the molten iron poured into the ladle 10 is too high, the reaction between the molten iron and the nodularizing agent produces excessive pressure in the ladle 10, and molten iron could be blown back out of the teapot spout 14, for example. When molten iron is treated with a magnesium containing alloy, it has been found that if the temperature of the molten iron poured into the teapot spout 14 exceeds approximately 2,800° F., this dangerous pressure build-up can occur.

If, on the other hand, the temperature of the molten iron poured into the ladle 10 is too low, the desired reaction between the molten iron and the nodularizing agent will not occur. Again for the treatment of molten iron with a magnesium containing alloy, the ideal temperature range for the molten iron has been found to be between 2,700° and 2,750° F. This results in the desired reaction betwen the molten iron and the nodularizing agent without excessive pressure build-up in the laddle 10. In a typical foundry arrangement, the molten iron would be poured into the ladle 10 from a holding furnace, and it is the temperature of the molten iron in this holding furnace that should be kept between 2,700° and 2,750° F. The heat loss while the molten iron is poured from the holding furnace into the lade 10 is negligible.

It should be understood that these temperatures may differ for the treatment of molten iron with a different reactant.

Various features of the invention are set forth in the following claims.

I claim:

1. A ladle for treatment of molten iron with a reactant, said ladle comprising a main chamber having sealed top and bottom ends, a teapot spout communicating with said main chamber of said ladle through a spout opening at the bottom end of said ladle, said spout being operative both for receiving molten iron poured into said ladle and for pouring treated iron out of said ladle, a dividing wall extending upwardly inside said main chamber from said bottom end of said ladle and forming a compartment within said main chamber adapted to contain the reactant, an opening in said sealed top end of said main chamber to allow placement of the reactant in said ladle compartment, a movable airtight cover mounted on said top end of said main chamber to provide said sealed top of said main chamber while said spout remains open to permit selective filling of molten iron into and dispensing of molten iron from said main chamber, and said dividing wall having a height greater than the height of said spout opening such that said dividing wall extends upwardly to a level above said spout opening and molten iron poured into said ladle fills said spout opening before flowing over said dividing wall into said compartment to react with the reactant, so that gases resulting from the reaction between the molten iron and the reactant cannot escape from said main chamber.

2. A ladle as set forth in claim 1 wherein said airtight cover is movably mounted on said top end of said main chamber by a hinge, said airtight cover being movable between a first position wherein said airtight cover engages said top end of said main chamber and closes said opening in said top end, and a second position wherein said airtight cover is at an angle relative to said top end so as to allow access to said opening in said top end of said main chamber.

3. A ladle in accordance with claim 2 and further comprising means mounted on said top end of said main cover for selectively securing said airtight cover in said airtight cover first position.

4. A ladle as set forth in claim 3 wherein said means for selectively securing said airtight cover comprises a toggle clamp mounted on said top end of said main cover adjacent said hinged airtight cover and being movable between a first position wherein said toggle clamp secures said airtight cover in said airtight cover first position, and a second position wherein said toggle clamp permits said airtight cover to move to said airtight cover second position.

5. A ladle as set forth in claim 2 and further comprising a gasket surrounding said opening in said top end of said main chamber, said gasket providing a seal between said top end and said airtight cover when said airtight cover is in said airtight cover first position.

6. In combination in a ladle for treatment of molten iron with a reactant, the ladle having a teapot spout communicating with the interior of the ladle through a spout opening, the spout being operative both for receiving molten iron poured into the ladle and for pouring treated iron out of the ladle, a dividing wall extending upwardly from the bottom of the ladle and forming a compartment within the ladle adapted to contain the reactant, the dividing wall having a height greater than the height of the spout opening such that said dividing wall extends upwardly to a level above said spout opening and molten iron poured into the ladle fills the spout opening before flowing over the dividing wall into the compartment to react with the reactant, a main cover closing the top of the ladle while leaving said spout open to recieve and dispense molten iron, an opening in the main cover to allow placement of the reactant in the ladle compartment, an airtight cover movably mounted on the main cover by a hinge, said airtight cover being movable between a first position wherein said airtight cover engages the main cover and closes the opening in the main cover so that gases resulting from the reaction between the molten iron and the reactant do not escape from the ladle, and a second position wherein said airtight cover is at an angle relative to the main cover so as to allow access into said ladle interior through the opening in the main cover, and a toggle clamp mounted on the main cover adjacent said airtight cover and being movable between a first position wherein said toggle clamp secures said airtight cover in said airtight cover first position, and a second position wherein said toggle clamp permits said airtight cover to move to said airtight cover second position.

7. In a ladle as set forth in claim 6, the improvement further comprising a gasket surrounding the opening in the main cover, said gasket providing a seal between the main cover and said airtight cover when said airtight cover is in said airtight cover first position.

8. A method for the treatment of molten iron with a reactant, said method being carried out in a ladle having a teapot spout communicating with the interior of the ladle through a spout opening, the spout being operative both for receiving molten iron poured into the ladle and for pouring treated iron out of the ladle, said method comprising the steps of placing a quantity of the reactant in the ladle interior, sealing the top of the ladle with a movable airtight cover while leaving said spout open to receive and dispense molten iron, and pouring molten iron into the ladle through the teapot spout and filling the ladle from the bottom up to a level above the opening of said spout into said ladle interior before said molten metal reaches and reacts with said reactant so that gases resulting from the reaction between the molten iron and the reactant cannot escape from the ladle interior.

9. A method as set forth in claim 8 wherein the airtight cover has an opening therein to allow placement of the reactant in the ladle compartment, and wherein said method further comprises the step of sealing the opening with a second airtight cover before pouring in the molten iron.

10. A method as set forth in claim 8 wherein the treatment of molten iron is with a nodularizing agent to produce iron with spheroidal graphite, and wherein said reactant is a quantity of the nodularizing agent.

11. A method as set forth in claim 10 wherein said placing step further comprises placing a quantity of magnesium containing alloy in the ladle compartment, and wherein said pouring step further comprises pouring molten iron at a temperature of between 2,700° and 2,750° F. into the ladle.

* * * * *